US009964867B2

(12) United States Patent
Saito et al.

(10) Patent No.: US 9,964,867 B2
(45) Date of Patent: May 8, 2018

(54) ELECTROPHOTOGRAPHIC PHOTORECEPTOR, MANUFACTURING METHOD AND IDENTIFICATION METHOD THEREOF, AND IMAGE FORMING APPARATUS

(71) Applicant: FUJI ELECTRIC CO., LTD., Kawasaki-shi, Kanagawa (JP)

(72) Inventors: Kazuya Saito, Matsumoto (JP); Keiichi Kurokawa, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days. days.

(21) Appl. No.: 15/280,172

(22) Filed: Sep. 29, 2016

(65) Prior Publication Data

US 2017/0139335 A1 May 18, 2017

(30) Foreign Application Priority Data

Nov. 18, 2015 (JP) ..... 2015-225946

(51) Int. Cl.

| | |
|---|---|
| ***G03G 15/00*** | (2006.01) |
| ***G03G 5/043*** | (2006.01) |
| ***G03G 5/10*** | (2006.01) |

(52) U.S. Cl.

CPC ..... *G03G 5/043* (2013.01); *G03G 5/10* (2013.01); *G03G 5/102* (2013.01); *G03G 15/75* (2013.01)

(58) Field of Classification Search

USPC ..... 399/9, 12, 13, 107, 110, 111, 116

See application file for complete search history.

(56) References Cited

U.S. PATENT DOCUMENTS

| | | | | |
|---|---|---|---|---|
| 6,369,842 | B1 * | 4/2002 | Abramsohn | G03G 5/144 347/116 |
| 8,862,001 | B2 * | 10/2014 | Okamoto | G03G 15/0189 399/49 |
| 2010/0086330 | A1 | 4/2010 | Nakano | |

FOREIGN PATENT DOCUMENTS

| | | | |
|---|---|---|---|
| JP | 2003-315353 | A | 11/2003 |
| JP | 2009-048206 | A | 3/2009 |
| WO | 2008/078783 | A1 | 7/2008 |

* cited by examiner

*Primary Examiner* — Hoan Tran

(74) *Attorney, Agent, or Firm* — Manabu Kanesaka

(57) ABSTRACT

Provided is an electrophotographic photoreceptor 1 including the outer periphery of a cylindrical substrate 20, at least a photosensitive layer 21. One or more processed lines 20*a* are provided on one or both of end portions in the axial direction outside an image forming region of the outer peripheral surface of the substrate 20 along the circumferential direction. Also provided is an image forming apparatus including the electrophotographic photoreceptor.

10 Claims, 2 Drawing Sheets

ELECTROPHOTOGRAPHIC PHOTORECEPTOR, MANUFACTURING METHOD AND IDENTIFICATION METHOD THEREOF, AND IMAGE FORMING APPARATUS

RELATED APPLICATIONS

The present application is based on, and claims priority from, Japanese Application No. JP2015-225946 filed Nov. 18, 2015, the disclosure of which is hereby incorporated by reference herein in its entirety.

TECHNICAL FIELD

The present invention relates to an electrophotographic photoreceptor (hereinafter, also simply referred to as "photoreceptor"), a manufacturing method and an identification method thereof, and an image forming apparatus, and more specifically to a technique of forming an individual identification marker for a cylindrical substrate used for an electrophotographic photoreceptor included in an image forming apparatus such as a copying machine.

BACKGROUND ART

An image forming apparatus of an electrophotographic system typically employs an electrophotographic photoreceptor in which a film of a functional layer including a photosensitive layer is formed on the outer peripheral surface of a cylindrical substrate. In some cases, characteristics of a photosensitive layer of an electrophotographic photoreceptor having such a configuration vary depending on a state of a substrate and conditions during film formation. In such cases, an electrophotographic photoreceptor having such a configuration influences image properties of an image forming apparatus including such an electrophotographic photoreceptor. Accordingly, an electrophotographic photoreceptor which is designed suitable for and dedicated for an image forming apparatus needs to be included in the image forming apparatus.

As an identification method of an electrophotographic photoreceptor, for example, a method of providing an individual identification code on a spigot joint portion which is provided at an end portion in the axial direction of a substrate has been proposed (see WO2008/078783, Japanese Unexamined Patent Application Publication No. 2009-48206). However, in this case, since an identification code is formed inside the substrate, there have been problems such as that it is difficult to perform individual identification when driving flanges are attached on both ends of a photoreceptor and that it is necessary to provide a manufacturing process dedicated for forming an identification code.

SUMMARY OF THE INVENTION

Problems to be Solved by the Invention

Accordingly, in order to solve the above-described problems, an object of the present invention is to provide an electrophotographic photoreceptor which can perform a more appropriate individual identification management without substantially influencing image formation, an image forming apparatus using the electrophotographic photoreceptor, a manufacturing method of the electrophotographic photoreceptor, and an identification method of the electrophotographic photoreceptor.

Means for Solving the Problems

In order to solve the above-described problems, the present inventors intensively studied to find that the above-described problems can be solved by providing a processed line for individual identification on the outer peripheral surface of a substrate used for a photoreceptor, thereby completing the present invention.

In other words, an electrophotographic photoreceptor of the present invention is an electrophotographic photoreceptor comprising, on the outer periphery of a cylindrical substrate, at least a photosensitive layer, wherein one or more processed lines are provided on one or both of end portions in the axial direction outside an image forming region of the outer peripheral surface of the substrate along the circumferential direction.

In the present invention, it is preferable that two or more of the processed lines are provided, and it is also preferable that the line width of the processed line is constant along the circumferential direction. It is still also preferable that the line widths of two or more of the processed lines are different from one another. Further, it is also preferable that the processed lines are provided on both end portions in the axial direction outside the image forming region of the outer peripheral surface of the substrate, wherein the processed lines at both end portions are provided at positions each the same distance away from each end of the substrate and have the same line width.

An image forming apparatus of the present invention comprises the above-described electrophotographic photoreceptor of the present invention.

Further, a manufacturing method of an electrophotographic photoreceptor of the present invention is a manufacturing method of an electrophotographic photoreceptor comprising, on the outer periphery of a cylindrical substrate, at least a photosensitive layer, the method comprising:

a substrate manufacturing step in which, while a cylindrically formed uncut substrate is rotated around an axis, a cutting tool is brought into contact with the outer peripheral surface of the uncut substrate and the uncut substrate and the cutting tool are relatively moved in the axial direction of the uncut substrate, thereby cutting the outer peripheral surface of the uncut substrate to manufacture a substrate, wherein, in the substrate manufacturing step, a relative velocity between the uncut substrate and the cutting tool is reduced at one or both of end portions in the axial direction outside an image forming region of the uncut substrate, whereby one or more processed lines are provided on the outer peripheral surface of the substrate along the circumferential direction.

Still further, an identification method of an electrophotographic photoreceptor of the present invention is an identification method of an electrophotographic photoreceptor comprising, on the outer periphery of a cylindrical substrate, at least a photosensitive layer, wherein one or more processed lines are provided on one or both of end portions in the axial direction outside an image forming region of the outer peripheral surface of the substrate along the circumferential direction for each substrate corresponding to an electrophotographic photoreceptor to be identified, and the electrophotographic photoreceptor is identified by using the processed lines.

Effects of the Invention

According to the present invention, an electrophotographic photoreceptor which can perform a more appropriate individual identification management without substantially influencing image formation, an image forming apparatus using the electrophotographic photoreceptor, a manufacturing method of an electrophotographic photoreceptor, and an identification method of an electrophotographic photoreceptor can be realized.

MODE FOR CARRYING OUT THE INVENTION

In the following, an embodiment of the present invention will be described in detail with reference to drawings, but the present invention is not limited thereto, and a variety of modifications can be made without departing from technical ideas of the present invention.

Figure 1:
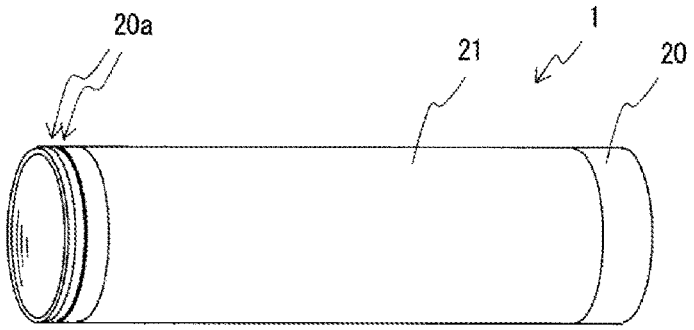
FIG. 1 is a schematic diagram illustrating one example of electrophotographic photoreceptor of the present invention.
Figure 2A:
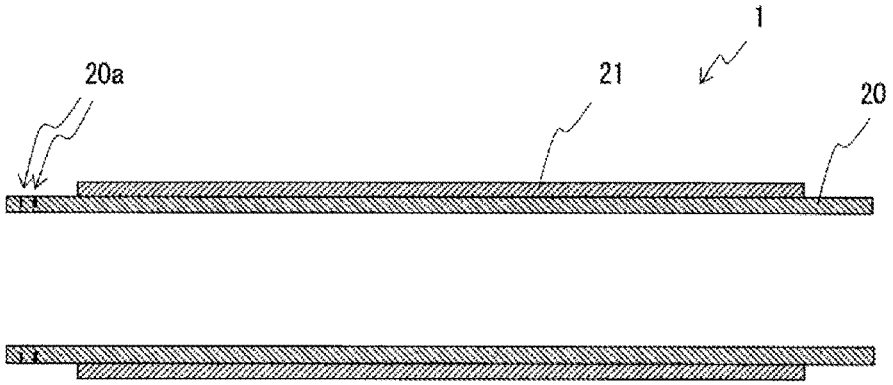
FIG. 2A is a schematic cross sectional diagram in the axial direction of an electrophotographic photoreceptor illustrated in FIG. 1.
Figure 2B:
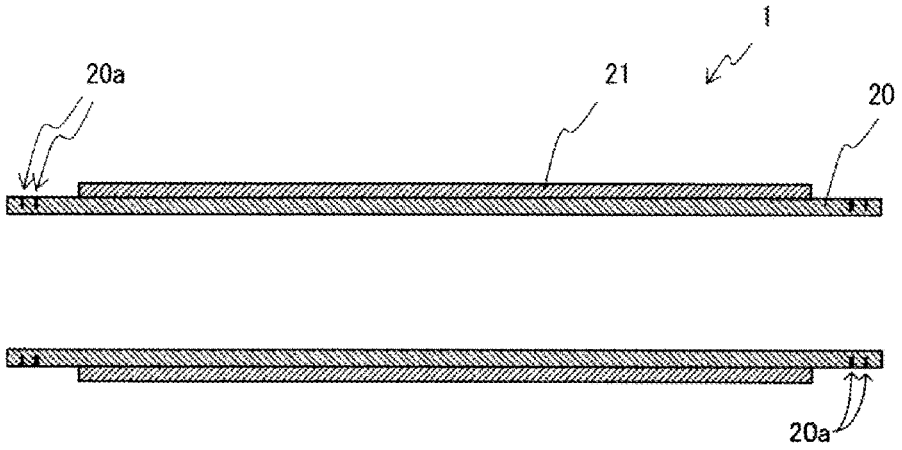
FIG. 2B is a schematic cross sectional diagram in the axial direction illustrating another example of an electrophotographic photoreceptor of the present invention.

FIG. 1 is a schematic diagram illustrating one example of electrophotographic photoreceptor of the present invention. FIG. 2A is a schematic cross sectional diagram in the axial direction of an electrophotographic photoreceptor illustrated in FIG. 1, and FIG. 2B is a schematic cross sectional diagram in the axial direction illustrating another example of an electrophotographic photoreceptor of the present invention. As illustrated, an electrophotographic photoreceptor 1 of the present invention comprises, on the outer periphery of a cylindrical substrate 20, at least a photosensitive layer 21.

The photoreceptor 1 of the present invention is characterized in that one or more processed lines (identification lines) 20*a* are provided on one (see FIG. 1 and FIG. 2A) or both (see FIG. 2B) of end portions in the axial direction outside an image forming region of the outer peripheral surface of the substrate 20 along the circumferential direction. Here, the image formation region means a region on the surface of a photoreceptor used for image formation by being in contact with a developing apparatus or the like when the photoreceptor is included in an image forming apparatus.

In other words, in the present invention, when one or more different processed lines are provided on the outer peripheral surface of the photoreceptor 1 for different types of photoreceptors or substrates, different types of photoreceptors or substrates can be identified by visual inspection or a detection apparatus. Since processed lines are provided on the outer peripheral surface, by providing a line detection apparatus such as a camera or an optical sensor at a position to face a substrate in an image forming apparatus, a photoreceptor can be discriminated also by the apparatus in addition to by visual inspection, thereby preventing misuse or employment of another type. In the present invention, the reliability of individual identification management can therefore be more secured when one of inspections by use of an apparatus including a detector such as an optical sensor or by a visual inspection is performed mainly and the other is performed for complementing the inspection which is performed mainly.

Further, in the present invention, since a processed line 20*a* is provided outside an image forming region, individual identification management can be performed easily without substantially influencing image formation. Still further, while, in a conventional art, it has been difficult to perform individual identification when driving flanges are attached to both ends of a photoreceptor since an identification unit is formed inside a substrate, according to the present invention, individual identification is possible by a visual inspection or the like even when flanges are attached to both ends of a substrate. In addition, such a photoreceptor of the present invention can be formed by making a machining speed variable in a cutting processing step in which the surface of a substrate 20 is made smooth as described below, and therefore, a manufacturing process dedicated for forming an identification unit as in a conventional art becomes unnecessary, which is also advantageous from the viewpoint of production cost.

In the following, an electrophotographic photoreceptor according to one embodiment of the present invention will be described in detail. An electrophotographic photoreceptor 1 which is illustrated at least comprises a cylindrical substrate 20 and a photosensitive layer 21 provided on the outer periphery thereof. Although not illustrated, the photoreceptor 1 may further comprise an undercoat layer between the substrate 20 and the photosensitive layer 21, or may comprise a surface protection layer on the photosensitive layer 21.

The substrate 20 is a framework of the photoreceptor 1, and comprises a processed line 20*a* for individual identification on one side or both sides of the outer peripheral surface thereof outside an image forming region along the circumferential direction. Here, the individual identification means identifying a plurality of types of substrates 20 and thus identifying each photoreceptor 1. A plurality of types of substrates mean substrates having different sizes or surface properties, and a plurality of types of photoreceptors mean photoreceptors having different sizes or different functional layers such as photosensitive layers.

The surface of the substrate 20 is electrically conductive. Examples of an electrically conducting material which constitutes the substrate 20 include aluminum (Al), stainless steel (SUS), zinc (Zn), copper (Cu), iron (Fe), titanium (Ti), nickel (Ni), chromium (Cr), tantalum (Ta), tin (Sn), gold (Au), silver (Ag), and an alloy thereof. Among these electrically conducting materials constituting the substrate 20, an Al alloy material is preferable from the viewpoint of easily cutting the surface thereof and easily forming a processed line thereon.

The photosensitive layer 21 comprises a binding resin and a charge generating material, a hole transport material and an electron transport material as charge transport materials as main components, and further, various additives as needed. Examples of the photosensitive layer 21 include a single-layer type photosensitive layer which has both functions of charge generation and charge transport in a single layer, and a layered-type photosensitive layer formed by layering a charge generating layer mainly contributing to charge generation and a charge transport layer mainly contributing to charge transport. In the present invention, a photosensitive layer of any of these types may be used.

A processed line 20*a* according to the present invention is substantially a shallow groove extending along the circumferential direction on the outer peripheral surface of the substrate 20, and has optical reflection properties different from those of other portions of the outer peripheral surface of the substrate 20, and therefore, the processed line 20*a* can be a marker for individual identification. For example, although the processed line 20*a* is recognized as a black line by visual inspection when formed on the substrate 20 made of an Al alloy material, the surface of the substrate is then subjected to an anodizing treatment to form an anodized film, the processed line 20*a* becomes a white line, which is easily recognized.

In the photoreceptor 1 of the present invention, the processed line 20*a* may be provided on one of end portions in the axial direction outside an image forming region as illustrated in FIG. 2A, by which an expected effect of the present invention can be obtained, or may be provided on both of the end portions as illustrated in FIG. 2B. When the processed lines 20*a* are provided on both end portions of the substrate 20, the same number of the processed lines 20*a* having the same line width may be provided on both end portions, or a different number of the processed lines 20*a* having a different line width may be provided on both end portions. In other words, both ends of the substrate 20 may be distinguished or may not be distinguished. Further, when the processed lines 20*a* are provided on both end portions in the axial direction outside an image forming region, the processed lines 20*a* at both end portions may be arranged at positions each the same distance away from each end of the substrate 20.

At least one processed line 20*a* needs to be provided, and as illustrated, two or more, for example, two to eight processed lines 20*a* may be provided. By changing the number of processed lines for the type of a substrate or a photoreceptor, individual identification ability can be more increased, thereby more effectively preventing misidentification such as during a manufacturing step or use of a photoreceptor. By providing the processed line 20*a* on either side outside an image forming region, a wrong operation when different flanges are attached on both ends of the substrate 20 can be prevented. The processed lines 20*a* are provided on both end portions in the axial direction outside an image forming region, which is more effective from the viewpoint of individual identification ability of a photoreceptor, and a type of a photoreceptor can be identified even when both ends (vertical ends) of the substrate 20 are reversed in a manufacturing step of the photoreceptor.

The processed line 20*a* can be provided with its line width constant along the circumferential direction depending on a forming process of a processed line described below. When two or more processed lines 20*a* are provided, the line widths of the two or more processed lines 20*a* may be the same, or as illustrated, may be different from one another. By changing the line width of processed lines as well as the number of processed lines for the type of a substrate or a photoreceptor, individual identification ability can be more increased, thereby more effectively preventing misidentification such as during a manufacturing step or use of a photoreceptor.

The processed line 20*a* can be provided, for example, at a line width of 0.4 to 5 mm. When the line width of the processed line 20*a* is too small, visibility cannot be sufficiently ensured; when the line width is too large, no advantage is found in the productivity. Although, when two or more processed lines 20*a* are provided, any distance between the processed lines 20*a* may be set, the distance is desired to be about 0.3 mm to 5 mm since two processed lines are hardly to be recognized when the distance between the processed lines 20*a* is too small or too large. Here, in the present invention, the processed line 20*a* is a grooved portion which is recessed from the outer surface of a substrate on which the processed line 20*a* is not provided, and the line width is substantially determined by a machining time for forming a processed line described below, i.e., a time during which a feeding rate of a cutting tool is changed or a distance which the cutting tool travels during the time.

The processed line 20*a* may be provided at any position as long as the position is outside an image forming region, and is preferably provided inside a position 1 mm away from an end of the substrate 20. When the processed line is too close to an end of the substrate 20, visibility may not be sufficiently ensured.

(Manufacturing Method of Photoreceptor)

Figure 3:
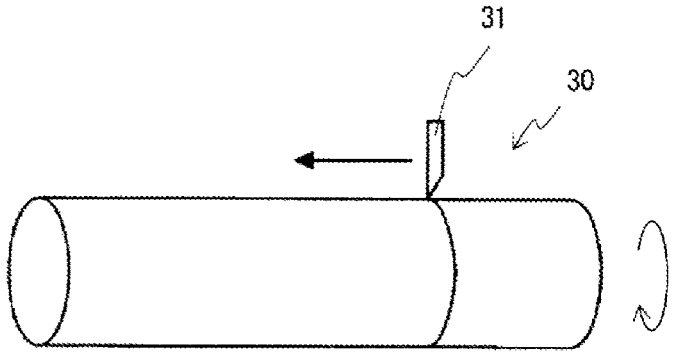
FIG. 3 is an explanatory drawing according to a manufacturing method of an electrophotographic photoreceptor of the present invention.

FIG. 3 illustrates an explanatory drawing concerning a manufacturing method of a photoreceptor of the present invention. As describe above, in the present invention, the processed line 20*a* can be formed at the same time when the outer surface of a substrate is cut in a cutting processing step. In other words, in a manufacturing step of a substrate when a photoreceptor is manufactured, in order to smooth the outer peripheral surface of a cylindrically formed uncut substrate to have a target roughness, a cutting processing is performed on the outer peripheral surface of an uncut substrate. In the cutting processing step, as illustrated in FIG. 3, usually, while a cylindrically formed uncut substrate 30 is rotated around an axis, a cutting tool 31 is brought into contact with the outer peripheral surface of the uncut substrate 30 and the uncut substrate 30 and the cutting tool 31 are relatively moved in the axial direction of the uncut substrate. At this time, a relative velocity between the uncut substrate 30 and the cutting tool 31 is reduced at one or both of end portions in the axial direction outside an image forming region of the uncut substrate 30, whereby one or more processed lines can be provided on the outer peripheral surface of the substrate to be obtained along the circumferential direction while cutting.

Specifically, for example, a cutting processing can be performed by moving the cutting tool 31 along the axial direction of the uncut substrate at a feeding rate of 0.2 to 0.4 mm/rev. while rotating the uncut substrate 30 at a rotation number of about 4000 to 6000 rpm. In this case, the processed line 20*a* can be formed by stopping a cutting tool at a position where the processed line 20*a* is formed or by allowing a feeding rate to be zero while rotating the uncut substrate. Specifically, for example, one processed line 20*a* can be formed by changing the feeding rate from 0.30 mm/rev. to 0 mm/rev. to stop the cutting tool at a position where the processed line 20*a* is formed, and after a stopping time of two seconds, restoring the feeding rate to 0.30 mm/rev. again. Similarly, two or more processed lines 20*a* can be formed by changing the feeding rate from 0.30 mm/rev. to 0 mm/rev. to stop the cutting tool at a position where the first processed line 20*a* is formed, and after a stopping time of two seconds, restoring the feeding rate to 0.30 mm/rev. again, next by changing the feeding rate from 0.30 mm/rev. to 0 mm/rev. to stop the cutting tool at a position where the second processed line 20*a* is formed, and after a stopping time of two seconds, restoring the feeding rate to 0.30 mm/rev. again, and repeating such a procedure. Here, the line width of the processed line 20*a* can be changed as needed by allowing the feeding rate to be a low rate such as 0.05 mm/rev., which is lower than a normal feeding rate and adjusting a machining time at such a low feeding rate instead of stopping the cutting tool at a position where the processed line 20*a* is formed. Although the line width is not changed when only a stopping time is changed, when the stopping time is longer, the color of black of the processed line 20*a* tends to appear denser.

Although, in the above-described case, the cutting tool is only moved in the axial direction with a cutting amount constant without being moved in the radial direction of the uncut substrate, the cutting tool may be moved in the radial direction of the uncut substrate to change a cutting amount.

Since the processed line 20*a* according to the present invention is formed by a cutting processing, the line width and the depth thereof include errors in manufacturing. For example, when the processed line 20*a* is formed by stopping the cutting tool as described above, variation of the line width is considered to be about ±0.4 mm.

In a manufacturing method of a photoreceptor of the present invention, the processed line 20*a* is formed simultaneously with a cutting processing step of an uncut substrate, and other steps such as a photoreceptor forming step may be appropriately performed by a usual method and are not particularly restricted. In the present invention, when a transparent photosensitive layer is used, a photosensitive layer may be applied also on a portion on which the processed line 20*a* is formed.

(Image Forming Apparatus)

An image forming apparatus of the present invention is characterized by comprising the above-described photoreceptor of the present invention. In other words, since an image forming apparatus of the present invention includes a photoreceptor comprising a processed line with which individual identification can be performed, in the image forming apparatus of the present invention, image formation conditions can be adjusted more appropriately by detecting the type of a photoreceptor by an optical sensor or the like, thereby performing printing more appropriately.

An image forming apparatus of the present invention includes a photoreceptor of the present invention, and an expected effect is obtained by applying the apparatus to various machine processes. Specifically, a sufficient effect can be obtained by an image forming apparatus of the present invention, also in a charging process such as a contact charging method using a roller, a brush, or the like or a contactless charging method using a corotron, a scorotron, or the like, and a developing process such as a contact developing method or a contactless developing method using, for example, a non-magnetic single-component, a magnetic single-component, or a two-component developing method (developer).

Figure 4:
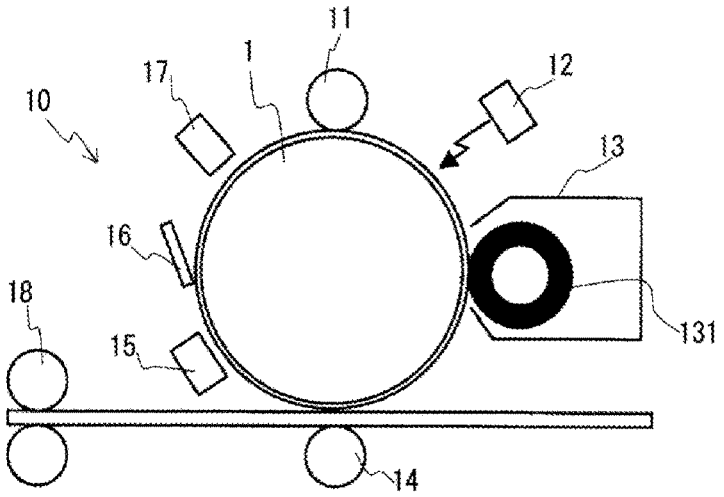
FIG. 4 is an explanatory drawing illustrating one example of an image forming apparatus of the present invention.

FIG. 4 is an explanatory drawing illustrating one example of an image forming apparatus of the present invention. An image forming apparatus 10 which is illustrated as one example of the present invention comprises an electrifying apparatus 11, an exposure apparatus 12, a development apparatus 13 comprising a developing roller 131, a transfer apparatus 14, a cleaning apparatus 16 such as a cleaning blade, and an electrical discharge apparatus 17, which are arranged on the outer periphery edge of the photoreceptor 1. The symbol 18 denotes a paper feed roller. An image forming apparatus as illustrated can perform individual identification of the photoreceptor 1, for example, by arranging the identification sensor 15 at a position to face the outer peripheral surface of a substrate of the photoreceptor 1 to detect the processed line 20*a*.

Figure 5:
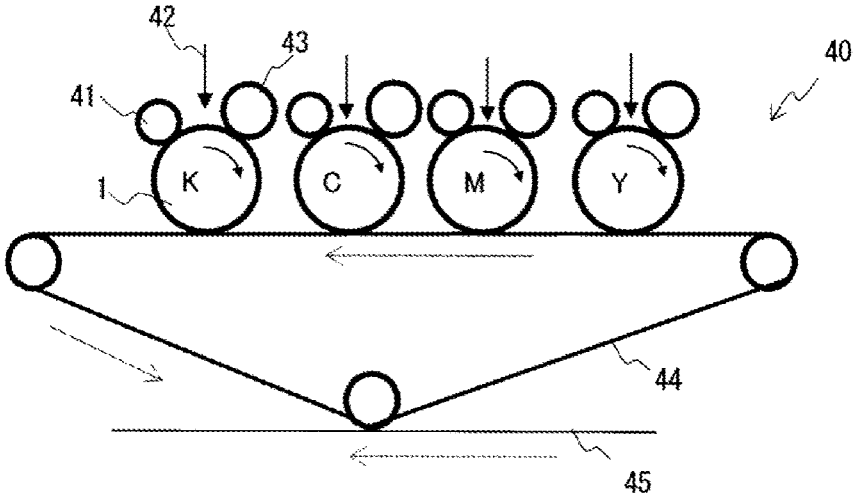
FIG. 5 is an explanatory drawing illustrating another example of an image forming apparatus of the present invention.

FIG. 5 is an explanatory drawing illustrating another example of an image forming apparatus of the present invention. An image forming apparatus 40 which is illustrated as another example of an image forming apparatus of the present invention is a tandem color printer, including four types of photoreceptors 1 for K: black, C: cyan, M: magenta, and Y: yellow, and an electrifying apparatus 41, an exposure apparatus 42, and a development apparatus 43 are arranged on the outer periphery edge of each of the photoreceptors 1. The symbol 44 denotes a transfer belt, and the symbol 45 denotes a recording medium such as a paper. Although not illustrated, also in such an image forming apparatus, individual identification of the photoreceptor 1 can be easily performed by arranging an identification sensor at a position at which the processed line 20*a* of each photoreceptor 1 can be detected.

(Identification Method of Photoreceptor)

In an identification method of a photoreceptor of the present invention, one or more processed lines 20*a* are provided on one or both of end portions in the axial direction outside an image forming region of the outer peripheral surface of the substrate along the circumferential direction for each substrate corresponding to a photoreceptor to be identified, and the photoreceptor is identified by using the processed line 20*a*. According to the present invention, as described above, individual identification of a photoreceptor can be performed even when driving flanges are attached on both ends of a substrate.

EXAMPLES

In the following, the present invention will be described in more detail by way of specific examples.

First, a cylindrically formed uncut aluminum substrate was prepared. Next, by performing a cutting processing on the outer surface of the uncut substrate, a substrate for a photoreceptor was manufactured, and at the same time, a processed line indicating individual identification information of the substrate was formed.

Specifically, using an ultra-precision lathe comprising the cutting tool 31, while the uncut substrate 30 is rotated around an axis at a rotation number of 5800 rpm, a cutting tool was brought into contact with the outer peripheral surface thereof, and the cutting tool was moved along the axial direction of the uncut substrate at a feeding rate of 0.3 mm/rev., thereby cutting the outer peripheral surface of the uncut substrate to manufacture a substrate for a photoreceptor. At this time, feeding of the cutting tool was stopped for 2 seconds at a position 3 mm away from the end of the substrate on one end portion in the axial direction outside an image forming region of the uncut substrate, to form the processed line 20*a* having a line width of about 1 mm, and the feeding rate was restored to 0.3 mm/rev., and further, the substrate from at a position 3.5 mm away from the end of the substrate to at a position 5.5 mm away from the end of the substrate was processed with the cutting tool at a feeding rate of 0.05 mm/rev. to form the processed line 20*a* having a line width of about 2 mm, and the feeding rate was restored to 0.3 mm/rev., thereby forming two processed lines along the circumferential direction. The line widths of the formed two processed lines 20*a* were both constant along the circumferential direction.

The obtained aluminum substrate 20 was washed by ultrasonic cleaning in a degreasing tank containing a detergent (trade name: Ellie's) at 45° C. Subsequently, a detergent (trade name: Castrol) was sprayed onto the surface of the substrate, the substrate was rubbed with a brush and rinsed with warm pure water, and then, water was removed by a drying furnace.

Next, a polycarbonate resin as a binding resin was dissolved in a solvent, and further, a charge generating material, a hole transport material and an electron transport material were dispersed therein to prepare a coating liquid for forming a photosensitive layer. The above-described aluminum substrate 20 was immersed in the above-described coating liquid, and then picked up therefrom to apply the above-described coating liquid in a film shape on the surface of the aluminum substrate 20 excepting portions from both ends of the substrate to positions 5 mm away from the ends. By heating and drying at 100° C. for 60 minutes to remove the solvent, a photosensitive layer 21 having a film thickness of 20 μm after drying was formed to manufacture the photoreceptor 1 as illustrated in FIG. 1, 2.

It was clearly confirmed in the obtained photoreceptor 1 by visual inspection or a sensor or the like that two processed lines 20*a* were formed on one of end portions in the axial direction outside an image forming region of the outer peripheral surface of the substrate 20 along the circumferential direction, and it was confirmed that individual identification of the photoreceptor could be performed by a state in which the processed line 20*a* was formed. When the photoreceptor 1 was mounted on a commercially available printer corresponding to FIG. 4 to produce a printout, no problem was found also in the printing state.

DESCRIPTION OF SYMBOLS

1 electrophotographic photoreceptor
10, 40 image forming apparatus
11, 41 electrifying apparatus
12, 42 exposure apparatus
131 developing roller
13, 43 development apparatus
14 transfer apparatus
15 identification sensor
16 cleaning apparatus
17 electrical discharge apparatus
18 paper feed roller
20 substrate
20*a* processed line
21 photosensitive layer
30 uncut substrate
31 cutting tool
44 transfer belt
45 recording medium

The invention claimed is:

1. An electrophotographic photoreceptor comprising, on an outer periphery of a cylindrical substrate, at least a photosensitive layer, wherein one or more processed lines are provided on one or both of end portions in an axial direction outside an image forming region of an outer peripheral surface of the substrate along a circumferential direction, and wherein a line width of the one or more processed lines is constant along the circumferential direction.

2. The electrophotographic photoreceptor according to claim 1, wherein the one or more processed lines are two or more processed lines.

3. The electrophotographic photoreceptor according to claim 2, wherein line widths of the two or more processed lines are different from one another.

4. The electrophotographic photoreceptor according to claim 3, wherein the two or more processed lines are provided on both end portions in the axial direction outside the image forming region of the outer peripheral surface of the substrate, and wherein the two or more processed lines at both end portions are provided at positions each being equally spaced away from each end of the substrate and have a same line width.

5. The electrophotographic photoreceptor according to claim 2, wherein the two or more processed lines are provided on both end portions in the axial direction outside the image forming region of the outer peripheral surface of the substrate, and wherein the two or more processed lines at both end portions are provided at positions each being equally spaced away from each end of the substrate and have a same line width.

6. The electrophotographic photoreceptor according to claim 1, wherein the one or more processed lines are provided on both end portions in the axial direction outside the image forming region of the outer peripheral surface of the substrate, and wherein the one or more processed lines at both end portions are provided at positions each being equally spaced away from each end of the substrate and have a same line width.

7. An image forming apparatus comprising the electrophotographic photoreceptor according to claim 1.

8. A manufacturing method of an electrophotographic photoreceptor comprising, on an outer periphery of a cylindrical substrate, at least a photosensitive layer, the method comprising:

a substrate manufacturing step in which, while a cylindrically formed uncut substrate is rotated around an axis, a cutting tool is brought into contact with an outer peripheral surface of the uncut substrate and the uncut substrate and the cutting tool are relatively moved in an axial direction of the uncut substrate, thereby cutting the outer peripheral surface of the uncut substrate to manufacture a substrate, wherein, in the substrate manufacturing step, a relative velocity between the uncut substrate and the cutting tool is reduced at one or both of end portions in the axial direction outside an image forming region of the uncut substrate, whereby one or more processed lines are provided on the outer peripheral surface of the substrate along a circumferential direction.

9. An identification method of an electrophotographic photoreceptor comprising, on an outer periphery of a cylindrical substrate, at least a photosensitive layer, the method comprising, recessing one or more processed lines in a form of a groove on one or both of end portions in an axial direction outside an image forming region of the outer peripheral surface of the substrate along a circumferential direction for each substrate corresponding to an electrophotographic photoreceptor to be identified, wherein the electrophotographic photoreceptor is identified by using the one or more processed lines.

10. The identification method according to claim 9, wherein a line width of the one or more processed line is constant along the circumferential direction.

* * * * *